US005401391A

United States Patent [19]

Collins et al.

[11] Patent Number: 5,401,391

[45] Date of Patent: Mar. 28, 1995

[54] DESULFURIZATION OF HYDROCARBON STREAMS

[75] Inventors: Nick A. Collins, Medford, N.J.; Mohsen N. Harandi, Langhorne, Pa.; Raymond D. McGraw, Oakton, Va.

[73] Assignee: Mobil Oil Corporation, Fairfax, Va.

[21] Appl. No.: 28,055

[22] Filed: Mar. 8, 1993

[51] Int. Cl.[6] ..... C10G 45/12

[52] U.S. Cl. ..... 208/208 R; 208/213; 208/227; 423/245.3; 423/244.11; 423/244.09

[58] Field of Search ..... 208/213, 227, 208 R; 423/244.09, 244.11, 245.3; 585/855

[56] References Cited

U.S. PATENT DOCUMENTS

| | | | |
|---|---|---|---|
| 4,090,949 | 5/1978 | Owen et al. | 208/78 |
| 4,746,762 | 5/1988 | Avidan et al. | 585/415 |
| 4,751,338 | 6/1988 | Tabak et al. | 585/415 |
| 4,753,720 | 6/1988 | Morrison | 208/135 |
| 4,778,661 | 10/1988 | Avidan et al. | 422/146 |
| 4,827,069 | 5/1989 | Kushnerick et al. | 585/415 |
| 4,855,521 | 8/1989 | Avidan et al. | 585/415 |
| 4,950,387 | 8/1990 | Harandi et al. | 208/49 |
| 4,992,607 | 2/1991 | Harandi et al. | 585/467 |
| 5,171,425 | 12/1992 | Muller | 208/208 R |

OTHER PUBLICATIONS

"Industrial Application of Shape Selective Catalysis", Chen et al., Catal. Rev.-Sci. Eng. 28(2&3), 247-249 (1986).

*Primary Examiner*—Helane Myers

*Attorney, Agent, or Firm*—A. J. McKillop; M. D. Keen

[57] ABSTRACT

A process for desulfurizing a hydrocarbon stream which includes at least 100 ppmw sulfur in the form of organic sulfur compounds, and $C_4$-hydrocarbons. The hydrocarbon stream is contacted in the absence of added hydrogen with a fluidized bed of an acidic catalyst having a structure of ZSM-5, ZSM-11, ZSM-22, ZSM-23, ZSM-35, ZSM-48, MCM-22, MCM-36, MCM-49, zeolite Y, zeolite beta or mixtures thereof to convert the organic sulfur compounds to hydrogen sulfide. The catalyst contacts the hydrocarbon stream at a pressure of from 0.0 psig to about 400 psig, a temperature of from about 400° F. to about 900° F., and a weight hourly space velocity of from about 0.1 $hr.^{-1}$ to about 10.0 $hr.^{-1}$. Thereafter, the hydrogen sulfide is removed from the hydrocarbon stream.

25 Claims, No Drawings

DESULFURIZATION OF HYDROCARBON STREAMS

BACKGROUND OF THE INVENTION

1. Field of the Invention

The present invention relates to the desulfurization of hydrocarbon streams. More specifically, the present invention relates to desulfurization of fuel gas hydrocarbon streams by converting organic sulfur compounds in the streams to hydrocarbon sulfide without added hydrogen.

2. Description of Prior Art

Stringent requirements will be set on refinery fuel gas to lower levels of sulfur, and thus minimize SOx emissions upon burning. Fuel gas sulfur levels as low as 40 ppm are contemplated in California while limits of 100 ppm may be imposed elsewhere in the United States.

Refinery fuel gases are typically purified before further treatment. This would normally involve the removal of hydrogen sulfide and mercaptans by means of alkaline absorbents, particularly alkanolamines, followed by sulfur production in a Claus process.

Solvents used for hydrogen sulfide absorption include aqueous solutions of monoethanolamine (MEA), diethanolamine (DEA), and diisopropanolamine (ADIP). These differ in volatility and selectivity for the removal of hydrogen sulfide, mercaptans, and carbon dioxide from gases of different composition. Other alkaline solvents used for absorption of acidic components in gases include potassium carbonate solutions with activators and solubilizers to improve gas/liquid contacting, sodium phenate and several other organic compounds (Alazid) and alkaline phosphates. In most of these sulfur is separated as concentrated hydrogen sulfide gas. However, in the Stretford process, an hydrogen sulfide saturated anthraquinone disulphonate solution is oxidized with air to produce elemental sulfur, which is precipitated and removed by filtration.

These fuel gas streams may be further desulfurized by passing the gas over a bed of molecular sieves or synthetic zeolites. Impurities are retained in the bed. When the bed is saturated, it is regenerated by passing hot clean gas or hot nitrogen, generally in a reverse direction.

Although conventional amine-based absorbers are very effective in removing hydrogen sulfide, these absorbers are much less efficient in reducing organic sulfur compounds such as COS and RSH.

SUMMARY OF THE INVENTION

The present invention provides a process for converting organic sulfur compounds in fuel gas to more easily removable hydrogen sulfide while simultaneously upgrading fuel gas olefins, if present, to gasoline range material. This low pressure desulfurization process may reduce or eliminate the need to expand or construct costly high pressure hydroprocessing facilities and hydrogen plants.

In accordance with a broad aspect of the present invention, there is provided a process for desulfurizing a hydrocarbon feed stream which comprises at least 100 ppmw sulfur in the form of organic sulfur compounds, and $C_4$- hydrocarbons commonly called fuel gas. The process comprises the steps of contacting the hydrocarbon stream in the absence of added hydrogen with an acidic catalyst to convert organic sulfur compounds to hydrogen sulfide, and then removing the hydrogen sulfide from the hydrocarbon stream. The catalyst is preferably in a fluidized bed. Further, the hydrocarbon feed stream may contain light olefins ($C_1$–$C_4$) typically found in LPG and/or the fuel gas, and these light olefins are upgraded to gasoline range product.

In accordance with a specific aspect of the invention, the acidic catalyst is a zeolite having a structure of ZSM-5, ZSM-11, ZSM-22, ZSM-23, ZSM-35, ZSM-48, MCM-22, MCM-36, MCM-49, zeolite Y, zeolite beta or mixtures thereof.

In accordance with another aspect of the invention, the hydrocarbon stream contacts the acidic catalyst at a pressure of from 0.0 psig to about 400 psig, preferably from about 50 psig to about 250 psig; a temperature of from about 400° F. to about 900° F.; and a weight hourly space velocity of from about 0.1 $hr.^{-1}$ to about 10.0 $hr.^{-1}$ preferably from about 0.1 $hr.^{-1}$ to about 2.0 $hr.^{-1}$.

Thus, the present invention provides an alternative method for desulfurization which can complement existing desulfurization facilities, and reduce capital expenditure on new or modified processes.

DESCRIPTION OF SPECIFIC EMBODIMENTS

Process Feed Stream

The refinery fuel gas feed stream treated by the process of this invention generally is derived from a waste stream from sources such as FCC off-gas or coker off-gas, and is typically composed of from about 5 vol % to about 40 vol % olefins, 0.0 to about 5 vol % of hydrogen, and other compounds such as methane, ethane and propane. This waste fuel gas stream should be pretreated to remove hydrogen sulfide, for example by one of the conventional amine based absorption processes described hereinabove. The pretreated waste fuel gas stream provides the refinery fuel gas hydrocarbon feed stream treated in accordance with the present invention and includes at least 100 ppmw of organic sulfur compounds such as COS and/or RSH, and may include at least 300 ppmw of such organic sulfur compounds.

More specifically, fuel gas streams are formed in a refinery by distillation and as reaction products. The most volatile fraction of a crude hydrocarbon mixture contains most of the gases which were originally dissolved in the crude and consists essentially of hydrocarbon gases ranging from methane to butane. Additional gas streams are products from processing of naphtha and middle distillate to produce gasoline, or from desulfurization processes involving hydrogen treatment of naphthas, distillates and residual fuels, or from coking or similar thermal treatments of vacuum gas oils and residual fuels.

Catalytic reforming of hydrocarbon fractions in the $C_7$ to $C_{10}$ range converts paraffinic and naphthenic hydrocarbons in the presence of hydrogen and a catalyst into aromatics or isomerized from straight-chain molecules to more highly branched hydrocarbons. This process produces a liquid product of higher octane number, and substantial quantities of gases. The gases are rich in hydrogen, and contain hydrocarbons from methane to butane. Because of the excess hydrogen in the gas, all products of catalytic reforming are saturated, and thus no olefinic gases are produced.

Catalytic cracking processes, such FCC, converts heavy gas oils into cracked gas, LPG, catalytic naphthas, fuel oils and coke by contacting the heavy hydrocarbon with hot catalyst. Cracking processes usually result in formation of unsaturated hydrocarbons, particularly ethylene, but also propylene, isobutylene and the normal butenes, in addition to hydrogen and methane and smaller quantities of ethane, propane, and saturated $C_4$ hydrocarbons. Diolefins such as butadienes isoprene are also present.

Gases are also produced with coking or visbreaking processes. In visbreaking, fuel oil undergoes liquid phase cracking reactions which result in formation of lighter fuel oil components, and gases mainly of hydrogen, methane and ethane. When coking a residual fuel oil or heavy gas oil, the feed is preheated and contacted with hot carbon. This results in extensive cracking of long-chain hydrocarbon molecules to form lighter products ranging from methane, LPG and naphtha to gas oil and heating oil. Coker products tend to be unsaturated, and olefinic components predominate in coker tail gas.

Another source of refinery fuel gas is hydrocracking, a catalytic high-pressure pyrolysis process in the presence of fresh and recycle hydrogen. Feedstock is heavy gas oil or residual fuel oil, and the process is directed to the production of middle distillates and gasoline. Surplus recycle gas and LPG product gas from hydrocracking are both saturated.

Refinery gases may be used without separation into dry gas and liquefiable components, particularly if all the gas produced is used as refinery fuel gas. However, a gas separation plant is used when dry gas and/or LPG are sold separately.

Liquefied petroleum gas (LPG) usually refers to mixtures of $C_3$ and $C_4$ hydrocarbons, which generally are obtained from petroleum refining operations or from natural gas. Both butane and propane are stored and transported as liquids, liquefaction being achieved either by relatively moderate compression or by refrigeration.

Process Parameters

In accordance with another aspect of the invention, the fuel gas hydrocarbon stream contacts a fluid bed of the acidic catalyst at a pressure of from 0.0 psig to about 400 psig, preferably from about 50 psig to about 250 psig; and at a temperature of from about 400° F. to about 900° F., preferably from about 700° F. to about 850° F. for ZSM-5, ZSM-12, ZSM-22, ZSM-23, ZSM-35 and ZSM-48. The preferred temperature range for MCM-22, MCM-36, MCM-49, zeolite Y and zeolite beta is from about 400° F. to about 800° F. The weight hourly space velocity of the stream is from about 0.1 $hr.^{-1}$ to about 10.0 $hr.^{-1}$, and preferably from about 0.1 $hr^{-1}$ to about 2.0 $hr^{-1}$.

It is preferred that the process of the present invention remove at least 30%, and more preferably at least 50%, of the organic sulfur compounds from the fuel gas feed stream.

Catalyst

The acidic catalyst used in the desulfurization process of the present invention is preferably a zeolite-based catalyst, that is, it comprises an acidic zeolite in combination with a binder or matrix material such as alumina, silica, or silica-alumina. The preferred zeolites for use in the catalysts in the present process are the medium pore size zeolites, especially those having the structure of ZSM-5, ZSM-12, ZSM-22, ZSM-23, ZSM-35, ZSM-48 or MCM-22. The medium pore size zeolites are a well-recognized class of zeolites and can be characterized as having a Constraint Index of 1 to 12. Constraint Index is determined as described in U.S. Pat. No. 4,016,218 incorporated herein by reference. Catalysts of this type are described in U.S. Pat. Nos. 4,827,069 and 4,992,067 which are incorporated herein by reference and to which reference is made for further details of such catalysts, zeolites and binder or matrix materials.

The present process may also use catalysts based on large pore size zeolites such as the synthetic faujasites, especially zeolite Y, preferably in the form of zeolite USY. Zeolite beta may also be used as the zeolite component. Other materials of acidic functionality which may be used in the catalyst include the materials identified as MCM-36 (described in U.S. patent application Ser. Nos. 07/811,360, filed Dec. 20, 1991 and 07/878,277, filed May 4, 1992) and MCM-49 (described in U.S. patent application Ser. Nos. 07/802,938 filed Dec. 6, 1991 and 07/987,850, filed Dec. 9, 1992). These applications describing MCM-36 and MCM-49 are incorporated herein by reference.

The particle size of the catalyst should be selected in accordance with the fluidization regime which is used in the process. Particle size distribution will be important for maintaining turbulent fluid bed conditions as described in U.S. Pat. No. 4,827,069 and incorporated herein by reference. Suitable particle sizes and distributions for operation of dense fluid bed and transport bed reaction zones are described in U.S. Pat. Nos. 4,827,069 and 4,992,607 both incorporated herein by reference. Particle sizes in both cases will normally be in the range of 10 to 300 microns, typically from 20 to 100 microns.

Thus, the preferred acidic zeolite catalysts are those exhibiting high hydrogen transfer activity and having a zeolite structure of ZSM-5, ZSM-12, ZSM-22, ZSM-23, ZSM-35, ZSM-48, MCM-22, MCM-36, MCM-49, zeolite Y, and zeolite beta.

These catalysts are capable of converting organic sulfur compounds such as thiophenes and mercaptans to hydrogen sulfide without added hydrogen by utilizing hydrogen present in the hydrocarbon feed. Metals such as nickel may be used as desulfurization promoters.

These catalysts are also capable of simultaneously converting light olefins present in the fuel gas to more valuable gasoline range material. A fluid-bed reactor/regenerator is preferred over a fixed-bed system to maintain catalyst activity. Further, the hydrogen sulfide produced in accordance with the present invention can be removed using conventional amine based absorption processes such as those discussed hereinabove.

ZSM-5 crystalline structure is readily recognized by its X-ray diffraction pattern, which is described in U.S. Pat. No. 3,702,866. ZSM-11 is disclosed in U.S. Pat. No. 3,709,979, ZSM-12 is disclosed in U.S. Pat. No. 3,832,449, ZSM-22 is disclosed in U.S. Pat. No. 4,810,357, ZSM-23 is disclosed in U.S. Pat. Nos. 4,076,842 and 4,104,151, ZSM-35 is disclosed in U.S. Pat. No. 4,016,245, ZSM-48 is disclosed in U.S. Pat. No. 4,375,573 and MCM-22 is disclosed in U.S. Pat. No. 4,954,325. The U.S. Patents identified in this paragraph are incorporated herein by reference.

While suitable zeolites having a coordinated metal oxide to silica molar ratio of 20:1 to 200:1 or higher may be used, it is advantageous to employ aluminosilicate ZSM-5 having a silica:alumina molar ratio of about 25:1 to 70:1, suitably modified. A typical zeolite catalyst component having Bronsted acid sites may consist essentially of crystalline aluminosilicate having the structure of ZSM-5 zeolite with 5 to 95 wt. % silica, clay and/or alumina binder.

These siliceous zeolites are employed in their acid forms, ion-exchanged or impregnated with one or more suitable metals, such as Ga, Pd, Zn, Ni, Co and/or other metals of Periodic Groups III to VIII. The zeolite may include other components, generally one or more metals of group IB, IIB, IIIB, VA, VIA or VIIIA of the Periodic Table (IUPAC).

Useful hydrogenation components include the noble metals of Group VIIIA, especially platinum, but other noble metals, such as palladium, gold, silver, rhenium or rhodium, may also be used. Base metal hydrogenation components may also be used, especially nickel, cobalt, molybdenum, tungsten, copper or zinc.

The catalyst materials may include two or more catalytic components which components may be present in admixture or combined in a unitary multifunctional solid particle.

In addition to the preferred aluminosilicates, the gallosilicate, ferrosilicate and "silicalite" materials may be employed. ZSM-5 zeolites are particularly useful in the process because of their regenerability, long life and stability under the extreme conditions of operation. Usually the zeolite crystals have a crystal size from about 0.01 to over 2 microns or more, with 0.02–1 micron being preferred.

In the Example, the fluidized bed catalyst particles consist essentially of 25 wt % H-ZSM-5 zeolite, based on total catalyst weight, contained within a silica-alumina matrix and having a fresh alpha value of 5. However, in a fixed bed embodiment the catalyst may consist of a standard 70:1 aluminosilicate H-ZSM-5 extrudate having an acid value of at least 20, preferably 150 or higher.

The Alpha Test is described in U.S. Pat. No. 3,354,078, and in the *Journal of Catalysis*, Vol. 4, p. 527 (1965); Vol. 6, p. 278 (1966); and Vol. 61, p. 395 (1980), each incorporated herein by reference as to that description.

EXAMPLE

In the Example reported in the following Table, a mixed feed containing LPG, pyrolysis gasoline and light reformate was fed into a laboratory scale fluid bed reactor containing a fluidizable ZSM-5 catalyst at 800° F., 190 psig and a WHSV of 2.5 $hr^{-1}$. 51% of the sulfur contained in the feed stream was converted to hydrogen sulfide. This example also shows significant olefin conversion and octane uplift.

Because methyl mercaptan accounts for about two-thirds of the total feed sulfur, the data in the Table clearly indicate that the primary organic sulfur compound found in refinery fuel gas, $CH_3SH$, is at least partially converted to hydrogen sulfide over ZSM-5 in this Example.

TABLE

| Pygas/Lt. Reformate/LPG Desulfurization | | | |
|---|---|---|---|
| Operating Conditions | | | |
| Temperature, °F. | | 800 | |
| Pressure, psig | | 190 | |
| Total HC WHSV, $hr^{-1}$ | | 2.5 | |
| Catalyst Activity, alpha | | 5 | |
| Sulfur in Hydrocarbon Feed | | | |
| Total LPG Sulfur, ppmw | | 305 | |
| as $CH_3SH$ | | 300 | |
| as COS | | 5 | |
| Pygas/Lt. Ref. Sulfur, ppmw | | 79 | |
| Time on Stream, hours | 3.5 | | 8.5 |
| Feed Composition, wt % | | | |

TABLE-continued

| Pygas/Lt. Reformate/LPG Desulfurization | | | |
|---|---|---|---|
| LPG | | 34.7 | 34.9 |
| Pygas/Lt. Ref. | | 65.3 | 65.1 |
| Sulfur in Product Streams | | | |
| Liquid Product Sulfur, ppmw | | 40 | 44 |
| $H_2S$ in Offgas, ppmv | | 510 | 500 |
| Offgas $H_2S$/Feed Sulfur, % | | 51 | 51 |
| Offgas $H_2S$/Product Sulfur, % | | 72 | 70 |
| Composition, wt % | Feed | 3.5 Hrs | 8.5 Hrs |
| $C_4-$ | 34.7 | 26.7 | 26.2 |
| $C_5$ | 2.2 | 5.4 | 5.3 |
| $C_6$ | 44.4 | 33.2 | 35.0 |
| $C_7$ | 11.3 | 11.8 | 12.0 |
| $C_8$ | 4.8 | 9.3 | 9.3 |
| $C_9$ | 0.8 | 7.6 | 6.8 |
| $C_{10+}$ | 1.8 | 6.0 | 5.4 |
| $C_5^+$ R + 0/M + 0 | 79.5/73.8 | 88.8/81.8 | 88.4/81.0 |

In addition to reducing organic sulfur, the process of the present invention can upgrade dilute olefin streams such as FCC fuel gas, excess propane/propene not used in alkylation, and/or butene raffinate from MTBE production into high octane gasoline.

When olefins are present, the process includes multiple acid-catalyzed reactions occurring sequentially and simultaneously over ZSM-5. These reactions include olefin oligomerization, olefin redistribution and equilibration, cyclization, and aromatization and hydrogen transfer. Under appropriate conditions, paraffin cracking is also observed.

The process of the present invention operates in a dense fluid bed reactor and regenerator system using standard commercial air supply and catalyst handling equipment. Associated equipment for product recovery depends on the degree of integration with existing refinery operations and existing towers. The catalyst activity is maintained by withdrawing a slipstream from the reactor inventory and regenerating with air. Catalyst with low carbon is returned back to the reactor. The heat of combustion may be removed by flue gas and excess air, or by cooling coils. Thermal energy from the circulating catalyst provides part of the hydrocarbon feed preheat. The regenerator flue gas can be mixed into the FCC regenerator flue gas.

The reactor and regenerator operating temperatures are mild compared to FCC conditions. Expensive alloys or refractory linings are not required in the design. Operating pressure is designed to be compatible with existing FCC unsaturated gas plant pressure. Direct transfer of FCC offgas to the unit used in the present invention is preferred, avoiding the added cost of a compressor. FCC off gas needs only to go through a fuel gas amine contactor to remove hydrogen sulfide.

While the invention has been described in conjunction with specific embodiments thereof, it is evident that many alternatives, modifications, and variations will be apparent to those skilled in the art in light of the foregoing description. According, it is intended to embrace all such alternatives, modification, and variations as fall within the spirit and broad scope of the appended claims.

What is claimed is:

1. A process for desulfurizing a hydrocarbon stream including at least 100 ppmw sulfur in the form of organic sulfur compounds, and $C_4$-hydrocarbons comprising the steps of:

(a) pretreating said hydrocarbon stream to remove hydrogen sulfide;

(b) then contacting said hydrocarbon stream in the absence of added hydrogen with a fluidized bed of an acidic catalyst to convert said organic sulfur compounds to hydrogen sulfide; said catalyst contacting said hydrocarbon stream at a pressure of from 0.0 psig to about 400 psig, a temperature of from about 400° F. to about 900° F., and a weight hourly space velocity of from about 0.1 $hr.^{-1}$ to about 10.0 $hr.^{-1}$; and (c) removing hydrogen sulfide produced in step (b) from said hydrocarbon stream.

2. The process of claim 1 wherein said hydrocarbon stream contains at least 300 ppmw sulfur in the form of said organic sulfur compounds.

3. The process of claim 1 in which said hydrocarbon stream comprises a light olefin component including $C_4$-olefins.

4. The process of claim 3 in which said light olefin component contains at least 300 ppmw sulfur in the form of said organic sulfur compounds.

5. The process of claim 3 wherein a fluid catalytic cracking process produces said light olefin component.

6. The process of claim 1 wherein said catalyst is a zeolite catalyst.

7. The process of claim 6 wherein said zeolite comprises an intermediate pore size zeolite.

8. The process of claim 7 wherein said intermediate pore size zeolite has a structure of ZSM-5.

9. The process of claim 7 wherein said intermediate pore size zeolite has a structure of ZSM-5, ZSM-11, ZSM-22, ZSM-23, ZSM-35, ZSM-48, MCM-22 or mixtures thereof.

10. The process of claim 6 wherein said zeolite has a constraint index of 1 to 12.

11. The process of claim 6 wherein said zeolite comprises a large pore size zeolite.

12. The process of claim 11 wherein said zeolite comprises zeolite Y or zeolite beta.

13. The process of claim 1 wherein said hydrocarbon stream is contacted with said catalyst at a temperature of from about 600° F. to about 900° F.

14. The process of claim 13 wherein said hydrocarbon stream is contacted with said catalyst at a temperature of from about 700° F. to about 850° F.

15. The process of claim 14 wherein said catalyst is ZSM-5, ZSM-11, ZSM-22, ZSM-23, ZSM-35, ZSM-48 or mixtures thereof.

16. The process of claim 1 wherein said hydrocarbon stream is contacted with said catalyst at a temperature of from about 400° F. to about 750° F.

17. The process of claim 16 wherein said catalyst is MCM-22, MCM-36, MCM-49, zeolite Y, zeolite beta or mixtures thereof.

18. The process of claim 1 wherein said hydrocarbon steam is contacted with said catalyst at a pressure of from 50 psig to about 250 psig.

19. The process of claim 1 wherein said hydrocarbon stream is contacted with said catalyst at a weight hourly space velocity from about 0.1 $hr.^{-1}$ to about 5.0 $hr.^{-1}$.

20. The process of claim 1 wherein at least 30% of said organic sulfur compounds are removed from said hydrocarbon stream.

21. The process of claim 1 wherein at least 50% of said organic sulfur compounds are removed from said hydrocarbon stream.

22. A process for desulfurizing a hydrocarbon stream including at least 100 ppmw sulfur in the form of organic sulfur compounds, and $C_4$- hydrocarbons comprising the steps of:

a) pretreating said hydrocarbon stream to remove hydrogen sulfide;

(b) contacting said hydrocarbon stream in the absence of added hydrogen with a fluidized bed of an acidic catalyst having a structure of ZSM-5, ZSM-11, ZSM-22, ZSM-23, ZSM-35, ZSM-48, MCM-22, MCM-36, MCM-49, zeolite Y, zeolite beta or mixtures thereof to convert said organic sulfur compounds to hydrogen sulfide; said catalyst contacting said hydrocarbon stream at a pressure of from 0.0 psig to about 400 psig, a temperature of from about 400° F. to about 900° F. and a weight hourly space velocity of from about 0.1 $hr.^{-1}$ to about 10.0 $hr.^{-1}$; and (c) removing hydrogen sulfide produced in step (b) from said hydrocarbon stream.

23. The process of claim 22 wherein said catalyst comprises ZSM-5, ZSM-11, ZSM-22, MCM-49 ZSM-23, ZSM-35, ZSM-48 or mixtures thereof, and wherein said pressure is from about 50 psig to about 250 psig, said temperature is from about 700° F. to about 850° F. and said space velocity is from about 1.0 $hr.^{-1}$ to about 5.0 $hr.^{-1}$.

24. The process of claim 22 wherein said catalyst has a structure of ZSM-5.

25. The process of claim 22 wherein said catalyst comprises MCM-22, MCM-36, MCM-49, zeolite Y, zeolite beta or mixtures thereof, and wherein said pressure is from about 50 psig to about 250 psig, said temperature is from about 400° F. to about 800° F. and said space velocity is from about 1.0 $hr.^{-1}$ to about 5.0 $hr.^{-1}$.

* * * * *